US007194844B2

(12) United States Patent
Dennis

(10) Patent No.: US 7,194,844 B2
(45) Date of Patent: Mar. 27, 2007

(54) "C" SECTION STRUCTURAL CONNECTORS

(76) Inventor: Andrew Dennis, 70 Huntfield Dr., Henderson, NV (US) 89014

( * ) Notice: Subject to any disclaimer, the term of this patent is extended or adjusted under 35 U.S.C. 154(b) by 894 days.

(21) Appl. No.: 10/123,476

(22) Filed: Apr. 17, 2002

(65) Prior Publication Data

US 2003/0196404 A1 Oct. 23, 2003

(51) Int. Cl.
*E04B 2/00* (2006.01)

(52) U.S. Cl. ..... 52/582.1; 52/586.1; 52/584.1

(58) Field of Classification Search ..... 52/582.1, 52/586.1, 586.2, 584.1
See application file for complete search history.

(56) References Cited

U.S. PATENT DOCUMENTS 3,664,491 A * 5/1972 Scanlon et al. ..... 198/195
3,738,083 A * 6/1973 Shimano ..... 52/582
4,170,859 A * 10/1979 Counihan ..... 52/763
4,557,091 A * 12/1985 Auer ..... 52/282
4,741,505 A * 5/1988 Anderson ..... 248/357
4,774,792 A * 10/1988 Ballance ..... 52/282
4,891,920 A * 1/1990 Pingston ..... 52/145
5,338,137 A * 8/1994 Jensen ..... 410/146
5,363,612 A * 11/1994 Erickson ..... 52/239
5,996,299 A * 12/1999 Hsueh ..... 52/481.2
6,202,382 B1 * 3/2001 Conterno ..... 52/762
6,305,136 B1 * 10/2001 Hopton et al. ..... 52/309.7
6,553,730 B1 * 4/2003 Mueller et al. ..... 52/220.5

* cited by examiner

*Primary Examiner*—Carl D. Friedman
*Assistant Examiner*—Steven Marsh
(74) *Attorney, Agent, or Firm*—Gregory J. Nelson

(57) ABSTRACT

A prototype connector has a section in the general shape of the letter. "C", thereby causing it to have a convex outer surface. Ends of the prototype connector form lips that are contiguously connected through respective flanges to ends of a web. A connector for making a butt connection between two cement composite panels is formed by two prototype connectors that have outer surfaces of their webs welded together. A connector for making an "L" connection between the two panels is formed by welding an outer surface of a flange of one prototype connector to an outer surface of a web of another prototype connector. A connector for connecting the two panels together at a preselected angle is made by using two sheet metal plates to connect each flange of a first prototype connector to a flange of a second prototype connector. A connector for making an "X" connection between four cement composite panels is made by welding outer surfaces of flanges of a first two prototype connectors to outer surfaces of webs of a second two prototype connectors in a manner that causes the outer surfaces of the webs of the four prototype connectors to define a rectangle.

5 Claims, 7 Drawing Sheets

"C" SECTION STRUCTURAL CONNECTORS

BACKGROUND OF THE INVENTION

1. Field of Invention

This invention is in the general field of building construction and, more particularly, is for connecting panels that are used to make walls, a floor and a roof of a building.

2. Description of the Prior Art

In the panelized construction industry, a tongue and groove connection of panels is followed by either bonding the panels together or screwing them together to form a rigid wall. The wall is reinforced by either studs in the panel's core or support structures such as columns, beams, posts or rafters. The forming of the wall is an expensive, time consuming, labor intensive activity.

Wood construction dominates the panelized construction industry. The wood construction is fraught with problems such as warping, rot and insect infestation. Additionally, the wood construction is inherently a fire hazard and does not have the strength of a metal such as steel.

There is a need for an improved panel that does not warp, rot, is not affected by insects, does not require studs within the core of the panel, does not require support structures and is recognized by building codes. Additionally, there is a need for a connector that is usable to rapidly and economically connect improved panels to form a floor, a wall and a roof of a building.

SUMMARY OF THE INVENTION

An object of the present invention is a means for rapidly connecting together cement composite panels that are used to construct a building.

Another object of the invention is to reduce labor required at a building construction site.

Another object of the invention is to make walls, floors and roofs of a building that are sturdy yet do not include studs or support structures.

Another object of the invention is reduce theft of connectors from a construction site.

Another object of the invention is to form fire proof, rigid panel connectors that are capable of withstanding hurricane force winds and are not damaged by insects.

Another object of the invention is a connector that is readily concealed when it is used to connect panels together According to the present invention, a prototype connector has a section in the general shape of the letter, "C". Ends of the prototype connector form two lips that fit and are adapted to slide into two slots, respectively. on opposite sides of a cement composite panel used to construct a building. A plurality of prototype connectors have their outer surfaces connected to form a connector that connects together a plurality of the panels.

The invention provides connectors that are used to economically construct a shell of a building made from cement composite panels.

Other objects, features and advantages of the invention should be apparent from the following description of the preferred embodiment thereof as illustrated in the accompanying drawing.

DESCRIPTION OF THE PREFERRED EMBODIMENT

Figure 1:
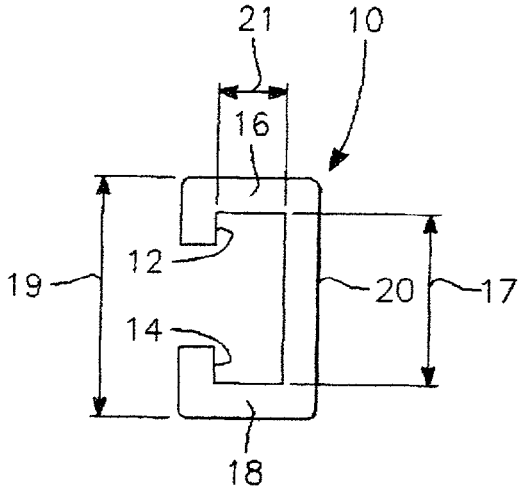
FIG. 1 is top view of a section of a prototype connector.

As shown in FIG. 1, a prototype connector 10 has a section in the general shape of the letter, "C". Because of the "C" shaped section, the prototype connector 10 has an inner concave surface and an outer convex surface. Correspondingly, the prototype connector 10 is comprised of elements that have an inner concave surface and an outer convex surface.

Ends of the prototype connector 10 form lips 12, 14 that are contiguously connected through flanges 16, 18, respectively, to ends of a web 20. A distance 17 separates inner surfaces of the flanges 16, 18. A distance 19 separates outer surfaces of the flanges 16, 18. A typical length of the prototype connector 10 is eight feet.

The prototype connector 10 is formed by "roll-forming" machinery from a gauge of steel that meets load requirements of its intended use. The prototype connector 10 is cut to a desired length after it is formed. Because the prototype connector 10 is made by roll forming, it is inexpensive to produce. As explained by example hereinafter, a connector that connects panels of a floor, a wall or a roof is formed by welding together outer surfaces of a plurality of prototype connectors.

Figure 2:
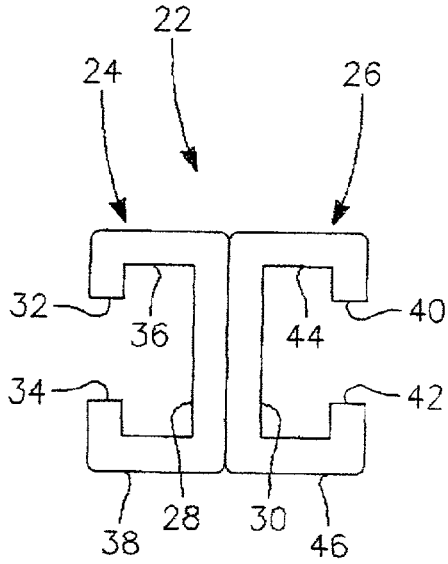
FIG. 2 is a top view of a pair of prototype connectors that are welded together to form a connector for making a butt connection between cement composite panels.

As shown in FIG. 2, in a first example of connector formation, a connector 22 is used for making a butt connection between two cement composite panels that form a wall of a building. The connector 22 is formed from prototype connectors 24, 26 that are similar to the prototype connector 10. The prototype connectors 24, 26 are in a back to back arrangement with an outer surface of a web 28 of the prototype connector 24 welded to an outer surface of a web 30 of the prototype connector 26.

The prototype connector 24 has lips 32, 34 that are contiguously connected through flanges 36, 38 to respective ends of the web 28. Similarly, the prototype connector 26 has lips 40, 42 that are contiguously connected to through flanges 44, 46, to respective ends of the web 30.

Figure 3:
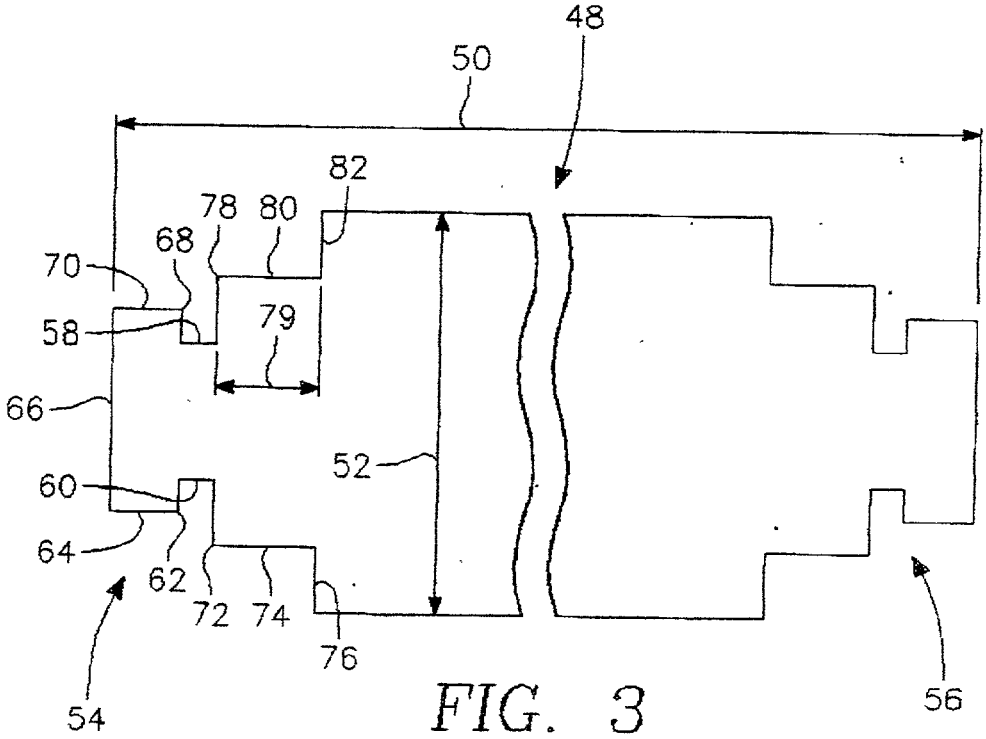
FIG. 3 is a top view of a cement composite panel.

As shown in FIG. 3, in this embodiment, a cement composite panel 48 has a width 50 of two and one half feet, a thickness 52 of four inches and is eight feet in length. In an alternative embodiment the width may be as large as four feet. Cement composite panels are well known to those skilled in the art.

It should be understood that as size of an exemplary panel is increased, its weight may increase enough to make it too heavy for movement through use of available construction machinery. Therefore, weight of the cement composite imposes a limitation on size of the panel 48.

A coupling region 54 is formed at one end of the panel 48; a coupling region 56 is formed at the other end. The coupling region 54 includes slots 58, 60 that are separated from each other by a distance substantially equal to a separation between the lips 12, 14 (FIG. 1). An edge 62 of the slot 60 is separated by the distance 21 (FIG. 1) from an end 66 of the panel 48. In a similar manner, an edge 68 of the slot 58 is separated by the distance 21 from the end 66. Surfaces 64, 70 of the coupling region 54 are separated from each other by the distance 17 (FIG. 1).

An edge 72 of the slot 60 is separated by a distance 79 from a boundary wall 76 of the coupling region 54. In a similar manner, an edge 78 of the slot 58 is separated by the distance 79 from a boundary wall 82 of the coupling region 54. Surfaces 74, 80 of the coupling region 54 are separated by the distance 19 (FIG. 1). The coupling region 56 is similar to the coupling region 54.

It should be understood that the coupling regions 54, 56 extend along the entire length of the panel 48. As explained hereinafter, coupling regions adapt either end of a panel, such as the panel 48, for a butt connection to a similar panel via the connector 22.

Figure 4:
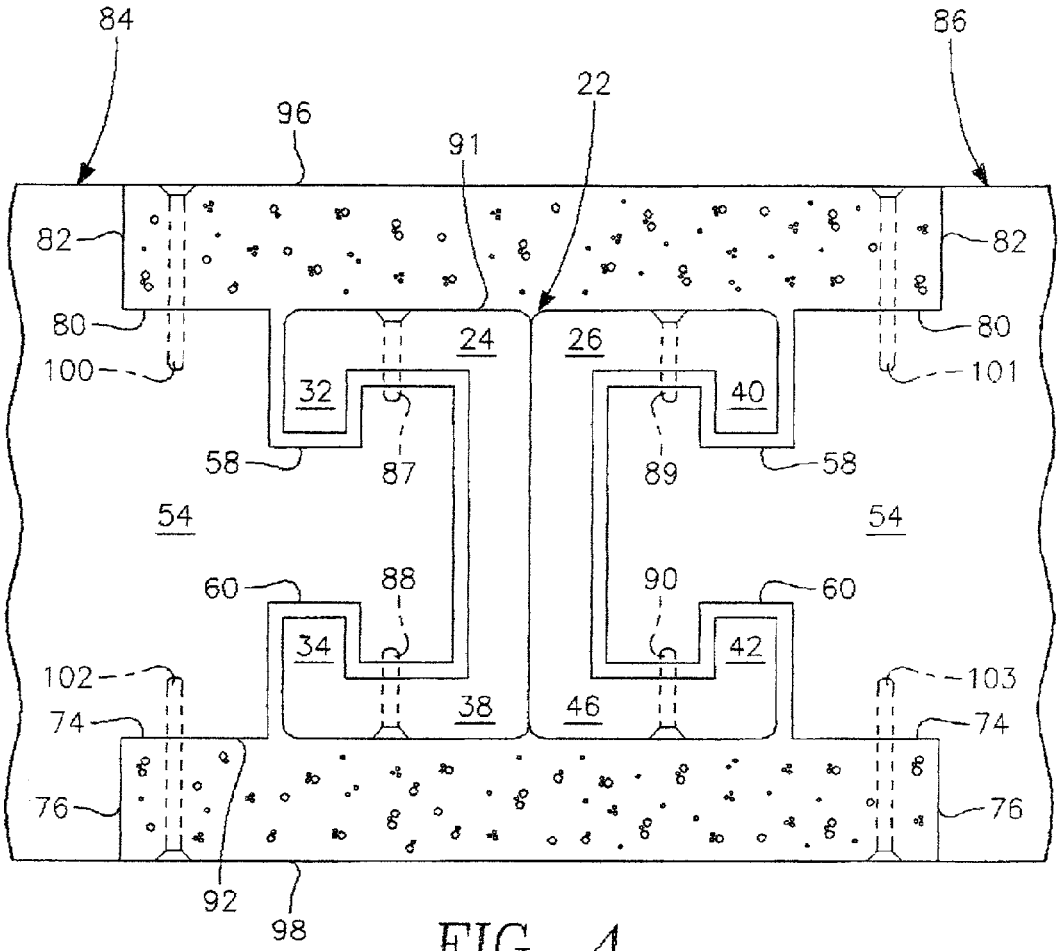
FIG. 4 is a top view of a pair of cement composite panels that are connected by the connector of FIG. 2.

As shown in FIG. 4, cement composite panels 84, 86 are similar to the panel 48 described hereinbefore whereby the panels 84, 86 each have the coupling region 54. The panels 84, 86 are connected by sliding the lips 32, 34 into the slots 58, 60, respectively, of the panel 84 and sliding the lips 40, 46 into the slots 58, 60, respectively, of the panel 86.

Screws 87, 88 are screwed through the flanges 24, 38, respectively, and into the panel 84 to prevent the lips 32, 34 from sliding within the slots 58, 60 of the panel 84. Screws 89, 90 are screwed through flanges 26, 46, respectively, and into the panel 86 to prevent the lips 40, 42 from sliding within the slots 58, 60 of the panel 86.

Because the surfaces 74, 80 are separated by the distance 19, the surfaces 80 and the exterior surfaces of the flanges 24, 26 provide a substantially flat surface 91 between the boundary walls 82. For similar reasons, the surfaces 74 and the flanges 38, 46 provide a substantially flat surface 92 between the boundary walls 76.

Cement boards 96, 98 are installed upon the surfaces 91, 92, respectively. Screws 100, 101 are exemplary of a plurality of screws that pass through the board 96 into the panels 84, 86, respectively, whereby the installation of board 96 is fixedly maintained. Similarly, screws 102, 103 are exemplary of a plurality of screws that pass through the board 98 into the panels 84, 86, respectively, whereby the installation of the board 98 is fixedly maintained. The boards 96, 98 protect the surfaces 91, 92 from an inclement environment that may cause corrosion and additionally serve a decorative purpose. Cement boards are well known to those skilled in the art.

Figure 5:
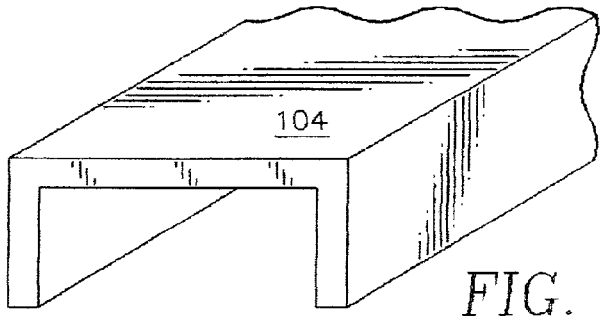
FIG. 5 is a perspective view of a portion of a top track which may be seated atop the cement panels of FIG. 4.

As shown in FIG. 5, a metal upper track 104 is fitted over the top of the butt connected panels 84, 86. A metal lower track, similar to the track 104, is fitted under the butt connected panels 84, 86.

When the butt connected panels 84, 86 are a wall of a shell of a building, the lower track is fixedly connected to a concrete foundation of the building. The track 104 and the lower track add structural rigidity to the wall. The use of upper and lower tracks is usually mandated by a government building code.

Figure 6:
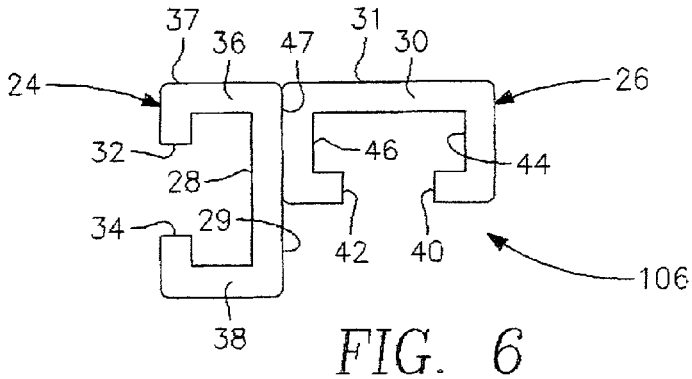
FIG. 6 is a top view of a pair of prototype connectors that are welded together to form a connector for making an "L" connection between cement composite panels.

As shown in FIG. 6, in a second example of connector formation, a connector 106 is used for making an "L" connection between two cement composite panels. The connector 106 is formed from the prototype connectors 24, 26 that are described hereinbefore. An outer surface 29 of the web 28 is welded to an outer surface 47 of the flange 46 in a manner that causes a surface 37 of the flange 36 and surface 31 of the web 30 to be substantially coplanar.

Figure 7:
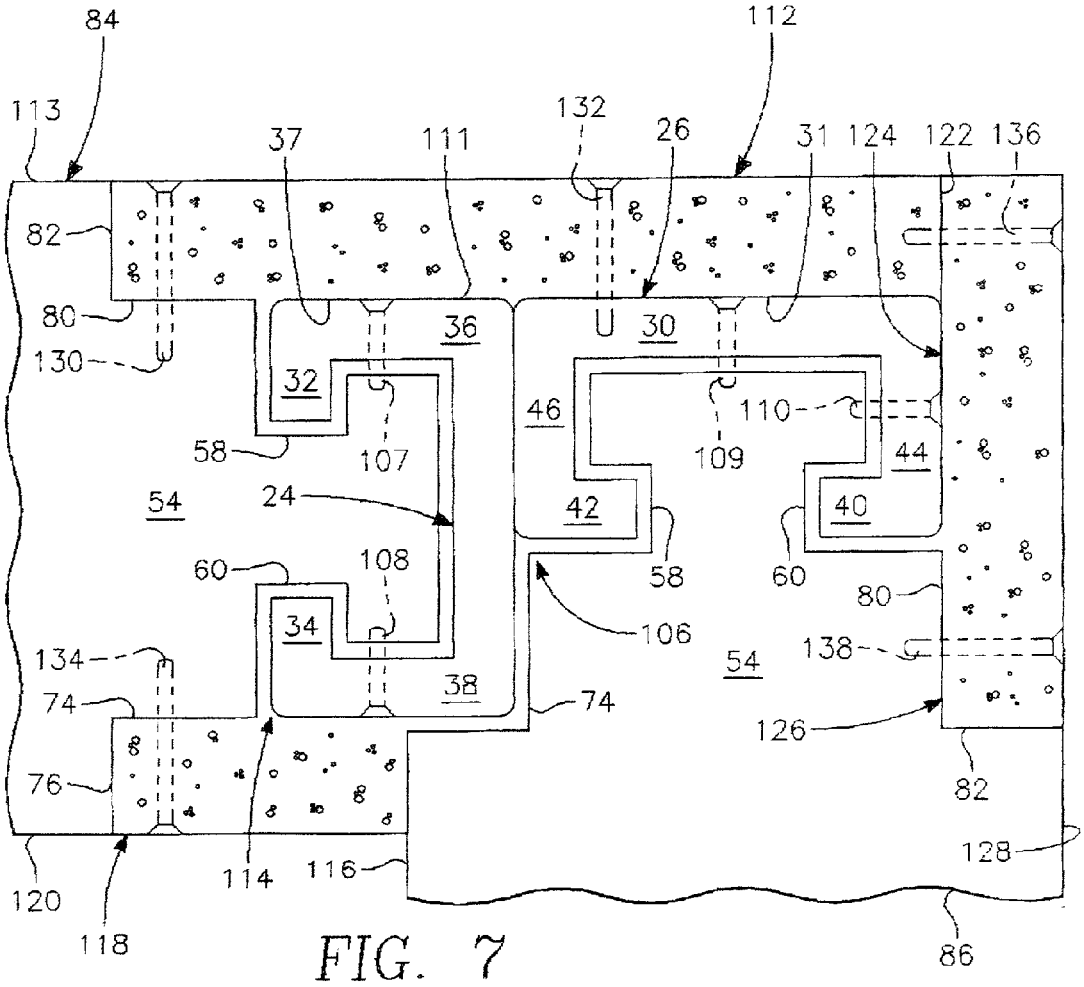
FIG. 7 is a top view of a pair of cement composite panels that are connected by the connector of FIG. 6.

As shown in FIG. 7, the "L" connection between the panels 84, 86 is made by sliding the lips 32, 34 into the slots 58, 60, respectively of the panel 84 and sliding the lips 40, 42 into the slots 60, 58, respectively, of the panel 86.

Screws 107, 108 are screwed through the flanges 36, 38, respectively, and into the panel 84. The screws 107, 108 prevent the lips 32, 34 from sliding within the slots 58, 60 of the panel 84. Similarly, screws 109, 110 are screwed through the web 30 and the flange 44, respectively, and into the panel 86. The screws 109,110 prevent the lips 40, 42 from sliding within the slots 58, 60 of the panel 86.

As explained hereinafter, three cement boards are installed to protect the surfaces 31, 37 and outer surfaces of the flanges 34, 38 from the inclement environment that may cause corrosion and for decorative purposes.

The surfaces 31, 37 and the surface 80 of the panel 84 form a substantially flat surface 111. A first cement board 112 is installed upon the surface 111. A top surface of the first board 112 is coplanar with a surface 113 of the panel 84.

An outer surface of the flange 38 and the surface 74 of the panel 84 form a substantially flat surface 114 that extends from the surface 76 of the panel 84 to a surface 116 of the panel 86. A second cement board 118 is installed upon the surface 114. A top surface of the second board 118 is substantially coplanar with a surface 120 of the panel 84.

A surface 80 of the panel 86, an outer surface of the flange 44 and an end 122 of the first board 112 form a substantially flat surface 124. A third cement board 126 is installed upon the surface 124. A top surface of the third board 126 is substantially coplanar with a surface 128 of the panel 86.

Screws 130, 132 are exemplary of a plurality of screws that pass through the first board 112 into the panel 84 and the web 30, respectively, whereby the installation of first board 112 is fixedly maintained.

A screw 134 is exemplary of a plurality of screws that pass through the second board 118 into the panel 84, whereby the installation of the second board 118 is fixedly maintained.

Screws 136, 138 are exemplary of a plurality of screws that pass through the third board 126 into the first board 112 and the panel 86, respectively, whereby the installation of the third board 126 is fixedly maintained.

Figure 8:
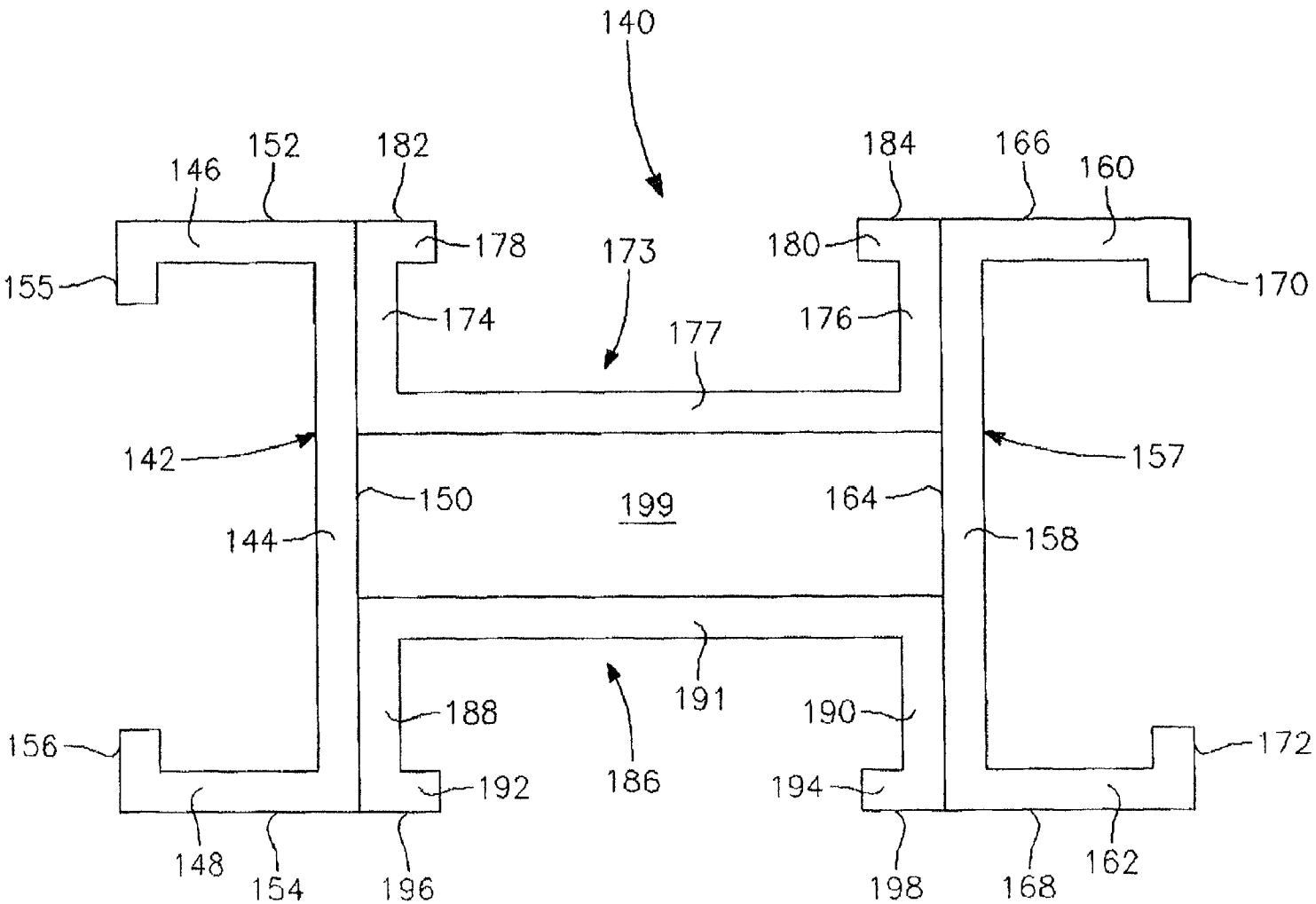
FIG. 8 is a top view of four prototype connectors that are welded together to form a connector for making an "X" connection between four cement composite panels.

As shown in FIG. 8, in a third example of connector formation, a connector 140 is used for making an "X" connection between four cement composite panels. The connector 140 is made from four prototype connectors that are similar to the prototype connector 10.

The connector 140 includes a first prototype connector 142 that has a web 144 and flanges 146, 148 with outer surfaces 150, 152 and 154, respectively. The prototype connector 142 additionally has lips 155, 156.

The connector 140 additionally includes a second prototype connector 157 that has a web 158 and flanges 160, 162 with outer surfaces 164, 166 and 168, respectively. The prototype connector 157 additionally has lips 170, 172.

The connector 140 additionally includes a third prototype connector 173 that has flanges 174, 176 and a web 177. An outer surface of the flange 174 is welded to the surface 150. An outer surface of the flange 176 is welded to the surface 164. The prototype connector 173 additionally has lips 178, 180 with outer surfaces 182, 184, respectively. The surfaces 152, 166, 182, 184 are all coplanar.

A fourth prototype connector 186 of the connector 140 has flanges 188, 190 and a flange 191. An outer surface of the flange 188 is welded to the surface 150. An outer surface of the flange 190 is welded to the surface 164. The prototype connector 186 additionally has lips 192, 194 with outer surfaces 196, 198, respectively.

The surfaces 154, 168, 196, 198 are all coplanar. Additionally, the surfaces 150, 164 and outer surfaces of the webs 177, 191 define a rectangle 199 in a central portion of the connector 140

Figure 9:
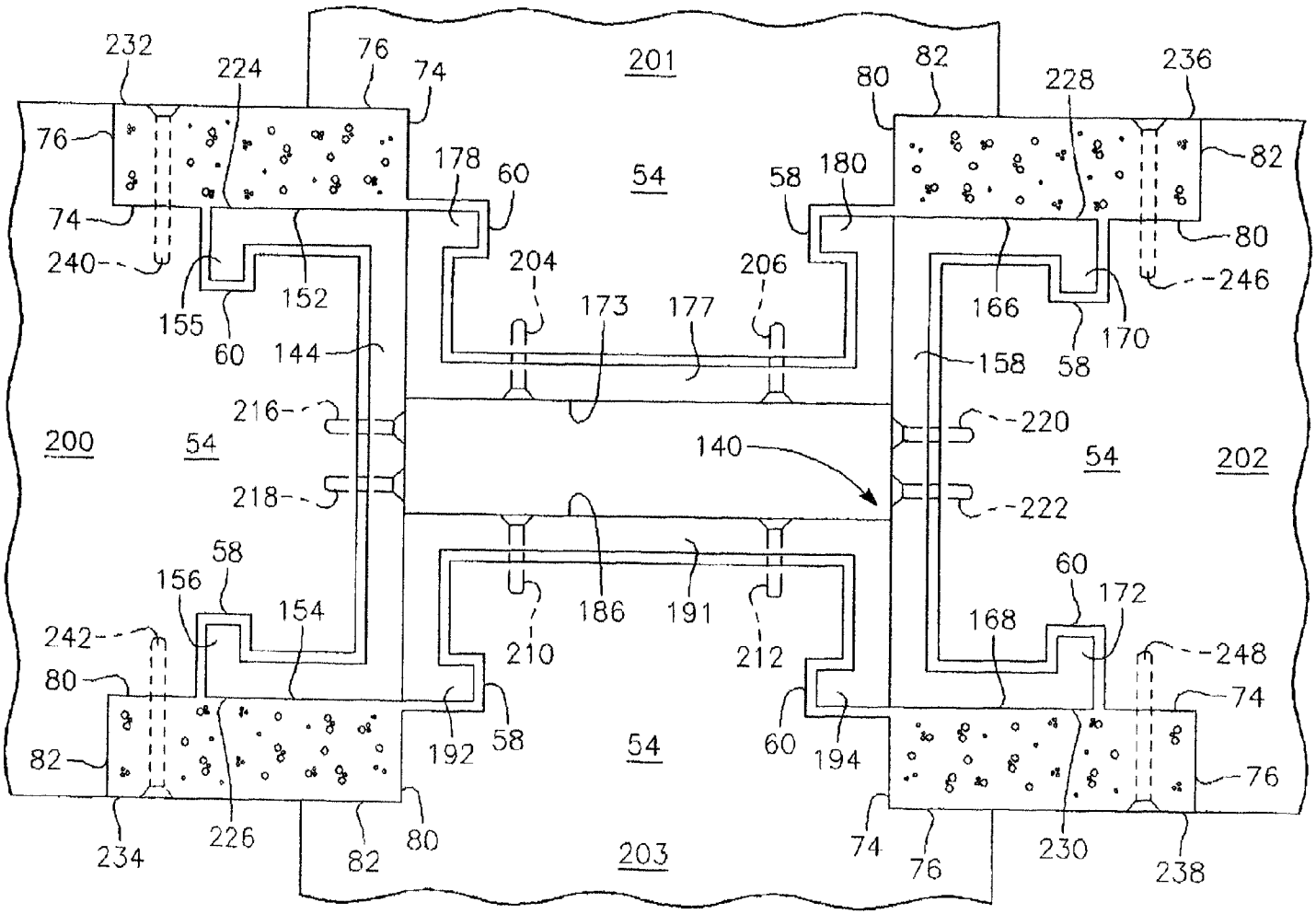
FIG. 9 is a top view of four cement composite panels that are connected by the connector of FIG. 8.

As shown in FIG. 9, cement composite panels 200–203 are similar to the panel 48 described hereinbefore whereby the panels 200–203 each have the coupling region 54. The panels 200–203 are connected by: sliding the lips 154, 156 into the slots 60, 58, respectively, of the panel 200; sliding the lips 178, 180 into the slots 60, 58, respectively, of the panel 201; sliding the lips 170, 172 into the slots 58, 60 of the panel 202; and sliding the lips 192, 194 into the slots 58, 60 of the panel 203.

After the panels 200–203 are connected, it is necessary to prevent the lips 155, 156, 170, 172, 178, 180, 192, 194 from further sliding. Screws 204, 206 pass through the web 177 into the panel 201 to prevent the lips 178, 180 from sliding within the slots 58, 60 of the panel 201; screws 210, 212 pass through the web 191 into the panel 203 to prevent the lips 192, 194 from sliding within the slots 58, 60 of the panel 203; screws 216, 218 pass through the web 144 into the panel 200 to prevent the lips 155, 156 from sliding within the slots 58, 50 of the panel 200; and screws 220, 222 pass through the web 158 into the panel 202 to prevent the lips 170, 172 from sliding within the slots 58, 60 of the panel 202.

Since the slots 58, 60 of the coupling region 54 are separated by a distance equal to a separation between the lips 12, 14 (FIG. 1) and the surfaces 74, 80 of the coupling region 54 are separated by the distance 19, the surface 152 and the surface 74 of the panel 200 are coplanar. Therefore, a substantially flat surface 224 extends from the boundary wall 76 of the panel 200 to the surface 74 board 201. For similar reasons, a substantially flat surface 226 extends from the boundary wall 82 of the panel 200 to the surface 80 of the panel 203. Correspondingly, a substantially flat surface 228 extends from the boundary wall 82 of the panel 202 to the surface 80 of the panel 201 and a substantially flat surface 230 extends from the boundary wall 76 of the panel 202 to the surface 74 of the panel 203.

Cement boards 232, 234, 236, 238 are installed upon the surfaces 224, 226, 228, 230, respectively. A screw 240 is exemplary of a plurality of screws that pass through the board 232 into the panel 200 whereby the installation of the board 232 is fixedly maintained. A screw 242 is exemplary of a plurality of screws that pass through the board 234 into the panel 200 whereby the installation of the board 234 is fixedly maintained.

Correspondingly, a screw 246 is exemplary of a plurality of screws that pass through the board 236 into the panel 202 whereby the installation of the board 236 is fixedly maintained. A screw 248 is exemplary of a plurality of a plurality of screws that pass through the board 238 into the panel 202 whereby the installation of the board 238 is fixedly maintained. The boards 232, 234, 236, 238 protect the surfaces 152, 154, 166, 168 from the inclement environment that may cause corrosion and additionally serve a decorative purpose.

Figure 10:
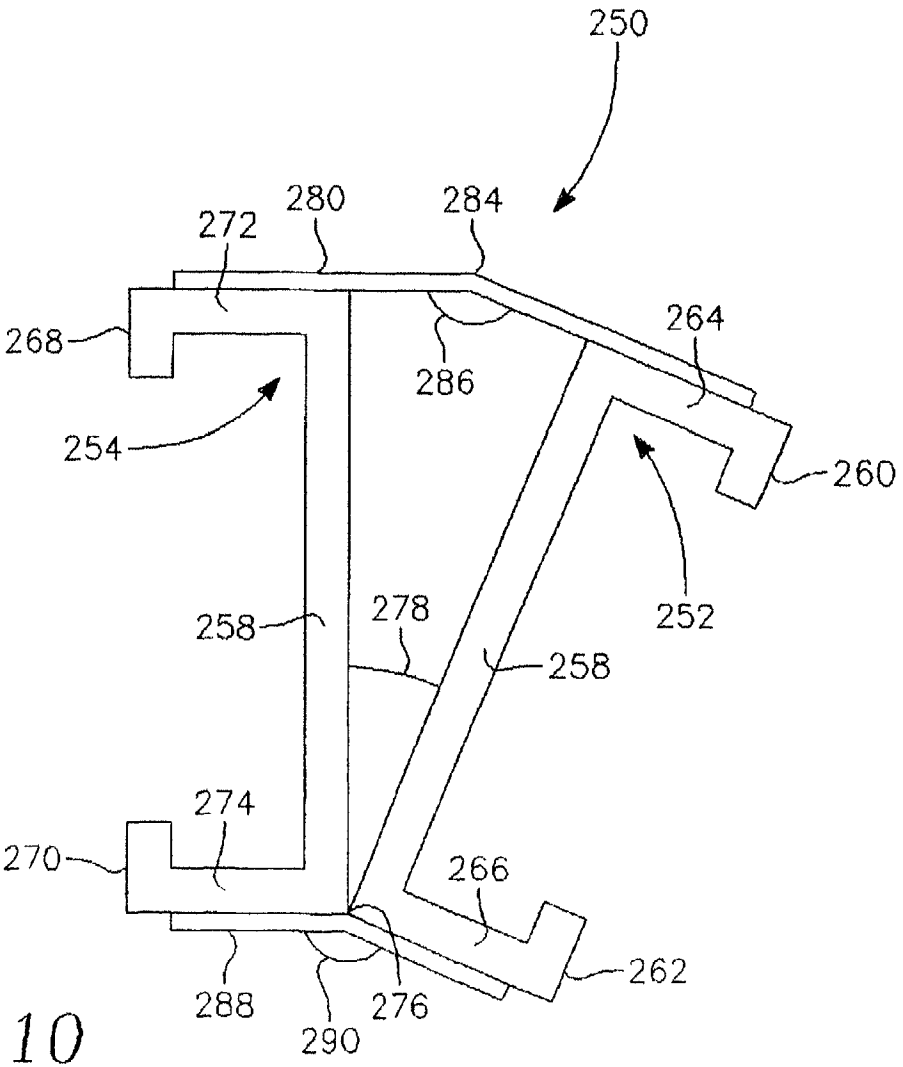
FIG. 10 is a top view of a pair of prototype connectors that are connected together to form a connector for making a selectable angle connection between cement composite panels.

As shown in FIG. 10, in a fourth example of connector formation, a connector 250 is used for connecting two composite panels at a preselected angle. The connector 250 is formed from "C" section prototype connectors 252, 254 that have webs 256, 258, respectively. The prototype connector 252 additionally has lips 260,262 connected to flanges 264, 266, respectively. The prototype connector 254 has lips 268, 270 connected to flanges 272, 274, respectively. The connectors 252, 254 are similar to the connector 10 (FIG. 1) described hereinbefore.

The prototype connectors 252, 254 have a relative disposition that causes the webs 256, 258 to have ends that are proximal to a vertex point 276. Additionally, the webs 256, 258 subtend a preselected angle 278. The relative disposition of the prototype connectors 252, 254 is maintained in a manner explained hereinafter.

A distal sheet metal plate 280 is welded to outer surfaces of the flanges 264, 266. The plate 280 is bent at a location 284 which is approximately midway between the webs 256, 258. At the location 284, the plate 280 subtends an angle 286 of approximately the supplement of the angle 278.

A proximal sheet metal plate 288 is welded to outer surfaces of the flanges 274, 266. The plate 288 is bent proximal to the vertex point 276 to subtend an angle 290. Like the angle 286, the angle 290 is approximately the supplement of the angle 278.

Figure 11:
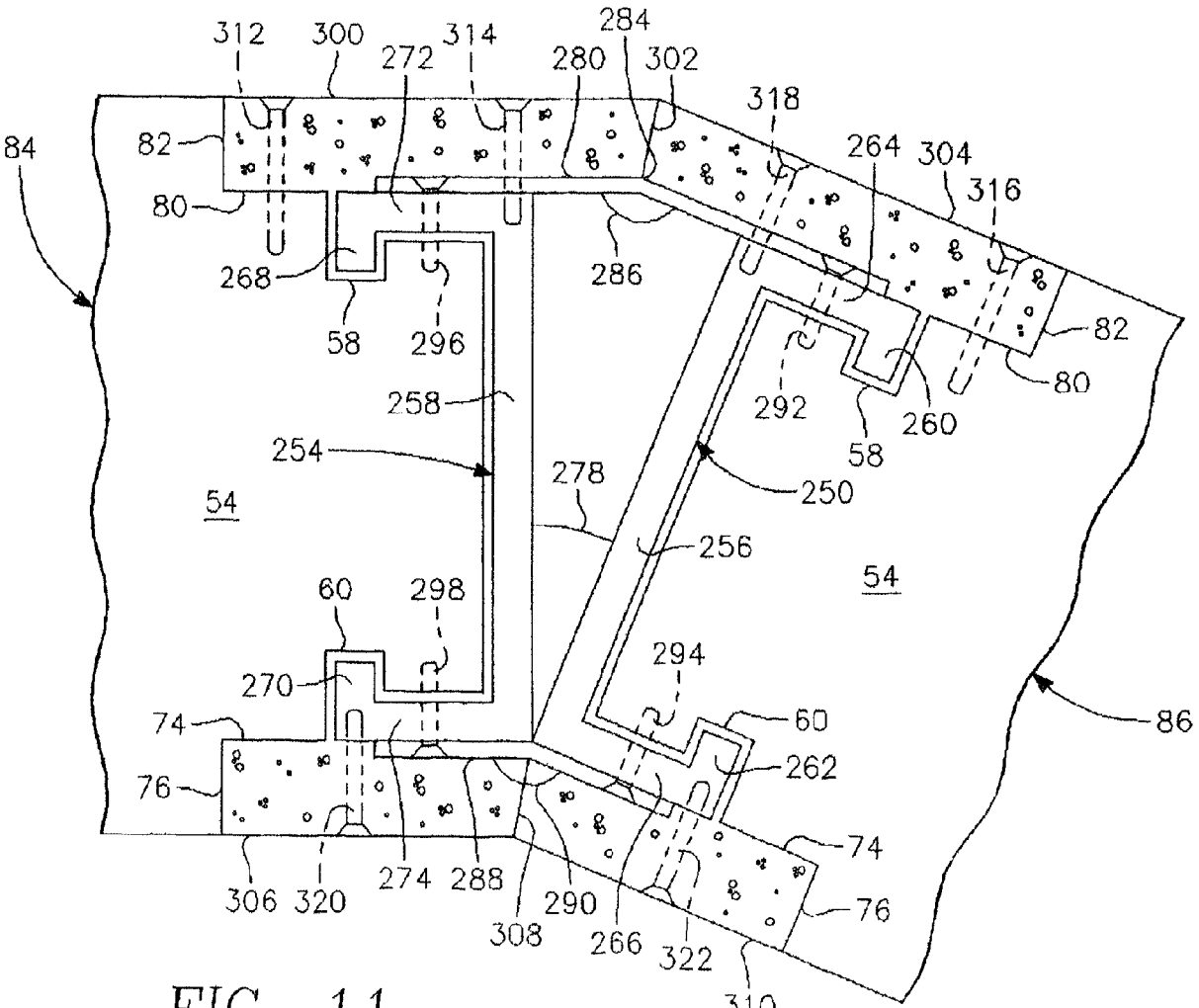
FIG. 11 is a top view of a pair of cement composite panels that are connected by the connector of FIG. 10.

As shown in FIG. 11, the preselected angle connection of the panel 84 to the panel 86 is made by sliding lips 268, 270 into the slots 58, 60 of the panel 84 and by sliding the lips 260, 262 into the slots 58, 60 of the panel 86.

After making the preselected angle connection, it is necessary to prevent the lips 260, 262, 268, 270 from further sliding. The lips 260, 262 are prevented from further sliding by a screw 292 that passes through the plate 280 and the flange 264 into the panel 86 and a screw 294 that passes through the plate 288 and the flange 266 into the panel 86. The lips 268, 270 are prevented from further sliding by a screw 296 that passes through the plate 286 and the flange 272 into the panel 84 and a screw 298 that passes through the plate 288 and the flange 274 into the panel 84.

A cement board 300 is installed between the boundary wall 82 of the panel 84 and a line 302 that bisects the angle 286. The board 300 rests upon the surface 80 of the panel 84 and the plate 280. A cement board 304 is installed between the boundary wall 82 of the panel 86 and the line 302 The board 304 rests upon the surface 80 of the panel 86 and the plate 280. Correspondingly, a cement board 306 is installed between the boundary wall 76 of the panel 84 and a line 308 that bisects the angle 278. The board 306 rests upon the surface 74 of the panel 84 and the plate 288. A cement board 310 is installed between the boundary wall 76 of the panel 86 and the line 308. The board 310 rests upon the surface 74 of the panel 86 and the plate 288.

A screw 312 passes through the board 300 into the panel 84. A screw 314 passes through the board 300 and the plate 280 into the web 258. The screws 312, 314 are each exemplary of a plurality of screws that fixedly maintain the installation of the board 300. Similarly, a screw 316 passes through the board 304 into the panel 86. A screw 318 passes through the board 304 and the sate 280 into the web 256. The screws 316, 318 are each exemplary of a plurality of screws that fixedly maintain the installation of the board 304

A screw 320 is exemplary of a plurality of screws that pass through the board 306 into the flange 274 whereby the installation of the board 306 is fixedly maintained. A screw 322 is exemplary of a plurality of screws that pass through the board 310 into the flange 266 whereby the installation of the board 310 is fixedly maintained. The boards 300, 304, 306, 310 protect the connector 250 from an inclement environment that may cause corrosion and additionally serve a decorative purpose.

While the invention has been shown and described with reference to embodiments thereof, it should be understood by those skilled in the art that changes in form and detail may be made therein without departing from the spirit and scope of the invention.

I claim:

1. A connector for connecting together first and second cement composite panels, comprising:

a first prototype connector having a section in the general shape of the letter "C", resulting in said first prototype connector having an outer convex surface, ends of said first prototype connector forming lips that are respectively connected through flanges to ends of a web;

a second prototype connector, similar to said first prototype connector, that has its outer surface connected to the outer surface of said first prototype connector, said first and second panels each having a coupling region with a pair of slots, lips of said first and second prototype connectors being adapted for sliding into said slots of said first and second panels, respectively, webs of said first and second prototypes being connected together in a back to back arrangement with outer surfaces of the flanges substantially coplanar, thereby providing first and second coplanar surfaces;

first and second screws that pass through a flange of said first prototype connector into said first panel and through a flange of said second prototype connector into said second panel, respectively; and a cement board for protecting said coplanar surfaces from an inclement environment.

2. A connector for connecting together first and second cement composite panels, comprising:

a first prototype connector having a section in the general shape of the letter "C", resulting in said first prototype connector having an outer convex surface, ends of said first prototype connector forming lips that are respectively connected through flanges to ends of a web;

a second prototype connector, similar to said first prototype connector, that has its outer surface connected to the outer surface of said $1^{st}$ prototype connector to make an "L" connection between the two cement composite panels wherein one of the flanges of said second prototype connector is connected to the web of said first prototype connector to cause the outer surface of one of the flanges of said first prototype connector to be substantially coplanar with the outer surface of the web of said second prototype connector first and second screws that pass through a flange of said first prototype connector into said first panel and through a flange of said second prototype connector into said second panel, respectively;

a cement board for protecting surfaces of said connector from an inclement environment.

3. Apparatus for connecting together first and second composite panels, comprising:

a first prototype connector having a section in the general shape of the letter "C", resulting in said first prototype connector having an outer convex surface, ends of said first prototype connector forming lips that are respectively connected through flanges to ends of a web;

a second prototype connector, similar to said first prototype connector, that has its outer surface connected to the outer surface of said first prototype connector, said first and second panels each having a coupling region with a pair of slots, lips of said first and second prototype connectors being adapted for sliding into said slots of said first and second panels, respectively;

first and second screws that pass through a flange of said first prototype connector into said first panel and through a flange of said second prototype connector into said second panel, respectively;

a connector for connecting two cement composite panels together at a preselected angle, wherein webs of said first and second prototype connectors each have first and second ends that are contiguously connected to first and second flanges, respectively, said first ends being disposed at a vertex point with said webs subtending said preselected angle;

a distal sheet metal plate that is connected to outer surfaces of said second flanges, said distal plate being bent approximately midway between said webs to subtend an angle that is the supplement of said preselected angle;

a proximal sheet metal plate that is connected to outer surfaces of said first flanges, said proximal plate being bent proximal to said vertex point to subtend said angle that is the supplement of said preselected angle, said sheet metal plates being connected to said flanges by welding.

4. Apparatus for connecting together first and second composite panels, comprising:

a first prototype connector having a section in the general shape of the letter "C", resulting in said first prototype connector having an outer convex surface, ends of said first prototype connector forming lips that are respectively connected through flanges to ends of a web;

a second prototype connector, similar to said first prototype connector, that has its outer surface connected to the outer surface of said first prototype connector, said first and second panels each having a coupling region with a pair of slots, lips of said first and second prototype connectors being adapted for sliding into said, slots of said first and second panels, respectively;

first and second screws that pass through a flange of said first prototype connector into said first panel and through a flange of said second prototype connector into said second panel, respectively;

a connector for connecting two cement composite panels together at a preselected angle, wherein webs of said first and second prototype connectors each have first and second ends that are contiguously connected to first and second flanges, respectively, said first ends being disposed at a vertex point with said webs subtending said preselected angle, additionally comprising:

a distal sheet metal plate that is connected to outer surfaces of said second flanges, said distal plate being bent approximately midway between said webs to subtend an angle that is the supplement of said preselected angle;

a proximal sheet metal plate that is connected to outer surfaces of said first flanges, said proximal plate being bent proximal to said vertex point to subtend said angle that is the supplement of said preselected angle; and a cement board for protecting surfaces of said connector from an inclement environment that may cause corrosion.

5. Apparatus for connecting together composite panels, comprising:

a first prototype connector having a section in the general shape of the letter "C", resulting in said first prototype connector having an outer convex surface, ends of said first prototype connector forming lips that are respectively connected through flanges to ends of a web;

a second prototype connector, similar to said first prototype connector, that has its outer surface connected to the outer surface of said first prototype connector, said first and second panels each having a coupling region with a pair of slots, lips of said first and second prototype connectors being adapted for sliding into said slots of said first and second panels, respectively;

first and second screws that pass through a flange of said first prototype connector into said first panel and through a flange of said second prototype connector into said second panel, respectively;

a third prototype connector has flanges that are respectively connected to the webs of said first and second prototype connectors, a fourth prototype connector has flanges respectively connected to the webs of said first and second prototype connectors, outer surfaces of the webs of said prototype connectors substantially defining a rectangle.

a cement board for protecting surfaces of said connector from an inclement environment that may cause corrosion.

* * * * *